US007881487B2

(12) United States Patent
Dickel et al.

(10) Patent No.: US 7,881,487 B2
(45) Date of Patent: Feb. 1, 2011

(54) HEARING AID DEVICE WITH DIGITAL CONTROL ELEMENTS

(75) Inventors: Thomas Dickel, Buttenheim (DE); Thomas Kasztelan, Singapore (SG); Meng Kiang Lim, Singapore (SG)

(73) Assignee: Siemens Aktiengesellschaft, Munich (DE)

( * ) Notice: Subject to any disclaimer, the term of this patent is extended or adjusted under 35 U.S.C. 154(b) by 1160 days.

(21) Appl. No.: 11/541,229

(22) Filed: Sep. 29, 2006

(65) Prior Publication Data

US 2007/0081682 A1 Apr. 12, 2007

(30) Foreign Application Priority Data

Sep. 30, 2005 (DE) ..... 10 2005 047 052

(51) Int. Cl.
*H04R 25/00* (2006.01)

(52) U.S. Cl. ..... 381/314; 381/312; 381/323

(58) Field of Classification Search ..... 381/312, 381/314, 320, 321, 23.1, 323
See application file for complete search history.

(56) References Cited

U.S. PATENT DOCUMENTS

| | | | |
|---|---|---|---|
| 5,553,152 | A | 9/1996 | Newton |
| 5,659,621 | A | 8/1997 | Newton |

FOREIGN PATENT DOCUMENTS

| | | | |
|---|---|---|---|
| DE | 195 42 961 | C1 | 5/1997 |
| DE | 695 27 534 | T2 | 6/1997 |
| DE | 299 05 172 | U1 | 7/1999 |
| EP | 0 779 015 | B1 | 6/1997 |
| WO | 9607295 | A1 | 3/1996 |
| WO | WO 00/57672 | A2 | 9/2000 |

*Primary Examiner*—Tuan D Nguyen

(57) ABSTRACT

The invention is intended to simplify the operation of a hearing aid device. Toward that end, means are present in the hearing aid device for storing the value of a parameter which can be set by the hearing aid device wearer by actuation of a control element, which parameter value was valid before the hearing aid device was turned off, with the result that the value of the parameter that was valid before the hearing aid device was turned off will be set automatically as the current value of the parameter after the device is turned off and then turned back on again.

14 Claims, 1 Drawing Sheet

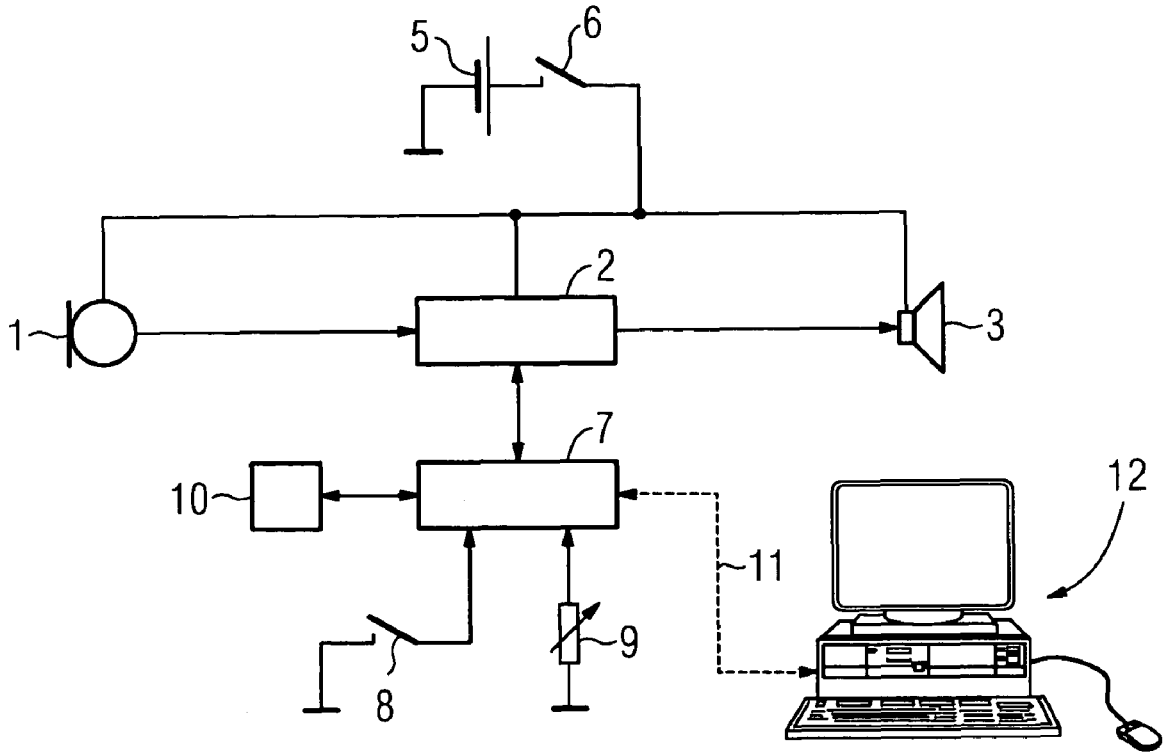
5
6
2
1
3
7
10
12
11
9
8

HEARING AID DEVICE WITH DIGITAL CONTROL ELEMENTS

CROSS REFERENCE TO RELATED APPLICATIONS

This application claims priority of German application No. 10 2005 047 052.1 filed Sep. 30, 2005, which is incorporated by reference herein in its entirety.

FIELD OF THE INVENTION

The invention relates to a hearing aid device which can be worn in the ear or on the ear of a hearing aid device wearer, said device having an input transducer for picking up an input signal and converting it into an electrical input signal, a signal processing unit for processing and amplifying the electrical input signal, an output transducer for converting the processed and amplified electrical input signal into an output signal that can be perceived as an acoustic signal by the hearing aid device wearer and a control device for turning the hearing aid device on and off and for setting a value for at least one parameter influencing the signal processing by the hearing aid device wearer, means being present for storing the value of the parameter set with the hearing aid device turned on in the turned-off hearing aid device and means for automatically setting the stored value of the parameter in question after the hearing aid device is turned on.

The invention further relates to a method for operating a hearing aid device of said kind.

BACKGROUND OF THE INVENTION

In a hearing aid device, an input signal is picked up by means of an input transducer and transformed into an electrical input signal. Typically, at least one microphone which picks up an acoustic input signal serves as the input transducer. State-of-the-art hearing aid devices frequently comprise a microphone system with a plurality of microphones in order to achieve a reception that is dependent on the incident direction of acoustic signals, referred to as a directional characteristic. However, the input transducers can also comprise a telephone coil or an antenna for picking up electromagnetic input signals. The input signals converted into electrical input signals by the input transducer are supplied to a signal processing unit for further processing and amplification. The further processing and amplification is performed in order to compensate for the individual hearing loss of a hearing aid device wearer usually as a function of the signal frequency. The signal processing unit emits an electrical output signal which is supplied via an output transducer to the hearing of the hearing aid device wearer so that the latter perceives the output signal as an acoustic signal. Earpieces which generate an acoustic output signal are typically used as output transducers. However, output transducers for generating mechanical vibrations are also known which directly stimulate specific parts of the hearing, such as, for example, the auditory ossicles, causing them to vibrate. Moreover, output transducers are known which directly stimulate nerve cells of the hearing.

In hearing aid devices, parameters relating to the signal processing can usually be set by the hearing aid device wearer. Parameters of this kind are, for example, the current hearing program for adjusting the signal processing in the hearing aid device to different environmental situations or for setting the volume. In modern-day hearing aid devices, the set values of the parameters in question are typically stored in digital form in a memory. In this case the value of a parameter can also be binary, for example if the parameter simply specifies whether a specific algorithm (e.g. noise suppression, static noise suppression, etc.) or a specific function (e.g. directional microphone) is activated or deactivated. In this case the parameters are set either by means of control elements mounted directly on the hearing aid device or by means of a remote control for the hearing aid device in question.

The central component of the signal processing unit of a modem hearing aid device is a digital signal processor (DSP). This can be implemented as freely programmable, hardwired or in a hybrid form. The values of settable parameters which influence the signal processing must first be read out from a memory after the device is turned on and transferred to the digital signal processor.

While a hearing aid device is being adjusted to the individual hearing loss of a hearing aid device wearer, default settings for the parameters which can be set by the hearing aid device wearer are specified in addition to parameters which the hearing aid device wearer can no longer change during the normal operation of the hearing aid device. In addition it is specified in which hearing program the hearing aid device will be operated by default after being turned on. The default settings initially defined in this way for the particular hearing aid device wearer are then set automatically each time the hearing aid device is turned on, i.e. they are read out from a nonvolatile memory and transferred to the digital signal processor.

EP 0779015 E1 discloses a hearing aid system having a hearing apparatus that is wearable in the ear and an external magnetic actuating element, wherein, in order to adjust operational parameters of the hearing apparatus, the external magnetic actuator is moved into proximity and out of proximity with the same. The known hearing apparatus comprises a memory device for storing the values of the parameters that are valid before the hearing apparatus is turned off and for adjusting said values after the hearing apparatus is turned back on again.

DE 299 05 172 U1 discloses a handheld programming device for hearing treatment appliances by means of which parameters of a hearing appliance relating to the signal processing can be adjusted.

SUMMARY OF THE INVENTION

The object of the present invention is to simplify the operation of a hearing aid device.

This object is achieved by a hearing aid device which is wearable on the ear or in the ear of a hearing aid device wearer and has the features claimed in the first independent claim.

The object is also achieved by a method for operating a hearing aid device which is wearable on the ear or in the ear of a hearing aid device wearer, said method comprising the method steps claimed in the second independent claim.

The basic idea of the invention is based on the premise that the values of the parameters of the hearing aid device which can be set by the hearing aid device wearer are stored in digital form in a nonvolatile memory while the hearing aid device is turned off. After the hearing aid device is turned on, the numeric values thus stored are instantly activated, with the result that signal processing in the hearing aid device is performed immediately after it is turned on, once again using precisely the values for the parameters concerned that were valid before the hearing aid device was turned off. This has the advantage that after being turned on again the hearing aid device automatically assumes the settings most recently selected by the hearing aid device wearer and consequently the latter does not have once again to manually select settings that are comfortable for him or her by operating control elements.

A further advantage of the invention emerges with regard to the supplying of hearing assistance to children. In order to avoid operating errors, the control elements on these devices are often protected by means of protective covers so that the control elements cannot be operated by the children. In this case, in order to operate a control element, the corresponding protective cover must first be removed. With devices of this type it is therefore particularly advantageous if the most recently selected settings are still valid after the device is turned off and is then turned back on again.

The values of the parameters which can be set by a hearing aid device wearer are advantageously stored in a nonvolatile memory which preserves the stored values even if the power supply is interrupted, for example in the turned-off state of the hearing aid device. The memory is preferably implemented as an EEPROM. In this case the current values of the parameters can either be stored in the memory immediately after each change or, alternatively, the hearing aid device can also be initially transferred to a turn-off mode after the actuation of a control element for turning off the hearing aid device, in which turn-off mode the current values are written into the memory in question before the power supply is interrupted.

The invention provides that by programming of the hearing aid device in question it is specified for which of the parameters that can be set by the hearing aid device wearer the values set prior to the hearing aid device being turned off are to be valid again after it is turned back on, and for which parameters a default setting is selected after the hearing aid device is turned on again. Thus, for example, it can be specified for a hearing aid device according to the invention that after being turned on said device will always be operated initially in the hearing program with the program number 1, although at the same time, in the case of the volume setting, the current value prior to the turning off of the hearing aid device will be set automatically.

It is further provided in a variant of the invention that not only the values of parameters set by the user are retained during the turned-off state, but also values of parameters which are set automatically by the hearing aid device during operation. In this case the settings selected automatically by the hearing aid device are mostly based on the result of a signal analysis. Settings of this kind relate in particular to the currently selected hearing program, currently used algorithms or functions (unwanted noise suppression, directional microphones) or automatic gain control.

BRIEF DESCRIPTION OF THE DRAWINGS

The invention is explained in more detail below with reference to an exemplary embodiment, the FIGURE showing a hearing aid device according to the invention in the block diagram.

DETAILED DESCRIPTION OF THE INVENTION

In the FIGURE, a microphone 1 is present for picking up an acoustic input signal and converting the acoustic input signal into an electrical input signal. The electrical input signal is supplied to a signal processing unit 2 for further processing and frequency-dependent amplification. Finally, the further processed and amplified signal is converted into an acoustic signal by an earpiece 3 and supplied to the hearing of a hearing aid device wearer. To supply power to the hearing aid device, a battery 5 is present which is connected to the different electronic hearing aid device components via an on/off switch 6.

The signal processing in the signal processing unit 2 of the hearing aid device can be adjusted by means of a control unit 7 to suit different hearing environments and hearing aid device wearer preferences. In this case parameters relating to the signal processing can also be determined and set automatically by the control unit 7, e.g. following an analysis of the current hearing situation. In addition, parameters relating to the signal processing can also be set manually by operation of control elements by the hearing aid device wearer. In the exemplary embodiment a pushbutton program selection switch 8 and a digital volume control 9 are present for this purpose.

In the hearing aid device according to the exemplary embodiment it can be specified by means of programming whether after the hearing aid device is turned on a predetermined hearing program and a predetermined volume setting (default setting) will be activated or whether the hearing program or volume setting which was set before the hearing aid device was turned off will be set. At least in the last-cited case the currently set hearing program or the currently set volume setting is stored in a nonvolatile memory 10. The latter retains the values stored therein even if the power supply for the hearing aid device is interrupted by opening of the switch 6. When the hearing aid device is turned on by closing of the switch 6 the values previously stored in the nonvolatile memory 10 are read out and transferred to the control unit 7, which then controls the signal processing in the signal processing unit 2 in respect of the selected hearing program or, as the case may be, in respect of the volume setting, using the values that were valid before the hearing aid device was turned off. Accordingly, the user does not have to make a fresh search for the settings that he or she perceived as comfortable prior to the device being turned off. The hearing aid device selects these settings automatically.

The hearing aid device according to the exemplary embodiment also has an interface 11 to a PC 12 via which the hearing aid device can be programmed. During the programming it can also be specified, at least in the case of some of the parameters that can be set by the user or automatically by the hearing aid device, whether a value that was valid before the device was turned off is also to continue to be valid immediately after it is turned on again or whether a default values is to be set for this.

The invention claimed is:

1. A hearing aid device for wearing on an ear of a hearing aid device wearer, comprising;

an input transducer which receives an input signal and converts the input signal into an electrical input signal;

a signal processing unit which processes and amplifies the electrical input signal;

an output transducer which converts the processed and amplified electrical input signal into an output signal which is perceived as an acoustic signal by the hearing aid device wearer;

a first control device which turns the hearing aid device on and off and sets a value of a parameter influencing the signal processing by the hearing aid device wearer;

a memory which stores the value of the parameter setting when the hearing aid device is turned off;

a calculating device comprising a program which determines whether the stored value of the parameter setting when the hearing aid device was turned off or a default parameter setting will be set for the hearing aid device after the hearing aid device is turned on; and a second control device which automatically sets the stored value of the parameter setting after the hearing aid device is turned on if the stored value of the parameter setting is selected.

2. The hearing aid device as claimed in claim 1, wherein the second control device automatically sets the stored value of the parameter setting immediately after the hearing aid device is turned on.

3. The hearing aid device as claimed in claim 1, wherein the memory for storing the value of the parameter setting is a nonvolatile memory.

4. The hearing aid device as claimed in claim 3, wherein the nonvolatile memory is an EEPROM.

5. The hearing aid device as claimed in claim 1, wherein the first control device comprises an on/off switch, a pushbutton program selection switch, and a digital volume control.

6. The hearing aid device as claimed in claim 5, wherein the hearing aid device is turned on or off by the on/off switch.

7. The hearing aid device as claimed in claim 5, wherein the parameter is a current hearing program setting set by the pushbutton program selection switch.

8. The hearing aid device as claimed in claim 5, wherein the parameter is a volume setting set by the digital volume control.

9. The hearing aid device as claimed in claim 1, wherein the hearing aid device determines whether the stored value of the parameter setting or a default parameter setting will be set after the hearing aid device is turned on by the program.

10. The hearing aid device as claimed in claim 1, wherein the hearing aid device is worn in the ear of the hearing aid device wearer.

11. The hearing aid device as claimed in claim 1, wherein the hearing aid device determines which parameters in the stored value of the parameter setting and which other parameters in the default parameter setting will be set after the hearing aid device is turned on.

12. The hearing aid device as claimed in claim 11, wherein the parameters in the stored value of the parameter setting comprise a volume setting and the other parameters in the default parameter setting comprise a hearing program setting.

13. A method for operating a hearing aid device for wearing on an ear of a hearing aid device wearer, comprising:

receiving an input signal;

converting the input signal into an electrical input signal;

processing and amplifying the electrical input signal;

converting the processed and amplified electrical input signal into an acoustic output signal;

setting a value of a parameter influencing the signal processing by the hearing aid device wearer;

storing the value of the parameter setting when the hearing aid device is turned off;

determining whether the stored value of the parameter setting when the hearing aid was turned off or a default parameter setting will be set for the hearing aid device after the hearing aid device is turned on; and setting the stored value of the parameter setting after the hearing aid device is turned on if the stored value of the parameter setting is selected.

14. The method as claimed in claim 13, wherein the hearing aid device is worn in the ear of the hearing aid device wearer.

* * * * *